US006523301B2

(12) United States Patent
Delaney

(10) Patent No.: US 6,523,301 B2
(45) Date of Patent: Feb. 25, 2003

(54) FLORAL ARRANGING DEVICE

(76) Inventor: Vicke T. Delaney, 2165 Ocean Beach Rd., Copalis Crossing, WA (US) 98536

( * ) Notice: Subject to any disclaimer, the term of this patent is extended or adjusted under 35 U.S.C. 154(b) by 0 days.

(21) Appl. No.: 09/902,832

(22) Filed: Jul. 10, 2001

(65) Prior Publication Data

US 2003/0009937 A1 Jan. 16, 2003

(51) Int. Cl.[7] ..... A47G 7/07
(52) U.S. Cl. ..... 47/41
(58) Field of Search ..... 47/41.01, 41.11, 47/41.12, 41.13, 78; D11/147

(56) References Cited

U.S. PATENT DOCUMENTS

| | | | | | |
|---|---|---|---|---|---|
| 451,645 | A | | 5/1891 | Tudor | |
| 1,260,042 | A | | 3/1918 | Pullman | |
| 1,465,636 | A | | 8/1923 | Gmelin | |
| 1,491,926 | A | | 4/1924 | Rosenwold | |
| 1,629,112 | A | | 5/1927 | MacDonald | |
| 2,818,681 | A | * | 1/1958 | Coplen | 47/84 |
| 3,245,175 | A | | 4/1966 | Klingberg | |
| 3,447,262 | A | | 6/1969 | Uhl | |
| 3,767,104 | A | | 10/1973 | Bachman et al. | |
| 4,282,683 | A | * | 8/1981 | Frankel | 47/41.01 |
| 4,958,461 | A | | 9/1990 | Aldrich | |
| D322,768 | S | * | 12/1991 | Lillelund et al. | D11/147 |
| 5,477,637 | A | | 12/1995 | Aldrich | |
| 5,758,452 | A | | 6/1998 | Matteucchi et al. | |
| 6,189,261 | B1 | * | 2/2001 | Helgesonq | 47/41.11 |

* cited by examiner

*Primary Examiner*—Charles T. Jordan
*Assistant Examiner*—Francis T. Palo
(74) *Attorney, Agent, or Firm*—Brian J. Coyne

(57) ABSTRACT

A floral arranging device for supporting plant stems in a floral arrangement in transit from florist to customer, as well as in a floral vase. In a first embodiment, three sets of parallel, elastic bands are looped across and around a substantially annular ring. The three sets are oriented at angles with respect to each other, thereby defining a plurality of interstices between the bands through which plant stems may be inserted and grasped by the bands at two spaced-apart locations along the lengths of the stems. In a second embodiment, a fourth set of parallel, elastic bands is added, thereby defining additional interstices. In a third embodiment, an annular enclosure surrounds the second embodiment, and fifth and sixth sets of parallel elastic bands are looped across, around, and under the enclosure.

11 Claims, 10 Drawing Sheets

FLORAL ARRANGING DEVICE

FIELD OF THE INVENTION

This invention relates generally to floral arranging aids and in particular to devices for supporting an arrangement of cut flowers, either for shipment or for display in a vase, bowl or the like.

BACKGROUND OF THE INVENTION

Ideally, a single floral arranging device should be capable of receiving and securely holding plant stems of widely varying diameters, and should be capable of retaining and displaying the floral arrangement materials in a wide variety of angular and spacial relationships. In this way, the floral designer is accorded maximum creative freedom. For maximum stability of the floral arrangement, the device should preferably engage each plant stem at more than one location along the length of the plant stem. A Such a device should also be capable of maintaining the floral arrangement during shipment from a florist to a customer so that the customer need only insert the device into the mouth of a floral vase or bowl in order to display the floral arrangement. Moreover, the device should be easily removable from a vase or bowl in order to facilitate changing the water therein or for moving the arrangement to a different receptacle. The device should also be inconspicuous so as not to detract from the floral design.

Floral arrangement devices that meet some, but not all, of these criteria have been disclosed. Pullman, U.S. Pat. No. 1,260,042, disclosed a flower holder attachment for supporting cut flowers within a bowl or receptacle, which included a single, transverse support composed of wire mesh or other reticulated material secured within an annular flange, the flange being tapered for engagement with the side walls of the receptacle. Matteucci et al., U.S. Pat. No. 5,758,452, disclosed a floral arranging aid for holding flowers in a vase. The aid comprised a single, transverse vase top cover of plastic or cardboard having a plurality of partially scored apertures that were opened by a flower stem. The apertures were arranged in rows and columns that were coded so that each aperture was located at a junction. Uhl, U.S. Pat. No. 3,447,262, disclosed a flower arranging device comprising a single, transverse arranging member within an annular rim portion. The rim portion was adapted to be juxtaposed to the outer periphery of the upper, open end of an associated vase or receptacle. A plurality of supporting members extended across the rim portion and intersected each other for defining a number of spaced gaps adapted to pass the stems of flowers or the like. By providing only a single, transverse, reticulated supporting member, each of these devices as disclosed by Pullman, Matteucci et al., and Uhl was capable of engaging plant stems at only a single point along the length of the stem, and so did not achieve the degree of stability desired for a floral arrangement or to withstand the physical rigors of shipment.

Rosenwald, U.S. Pat. No. 1,491,926, and Klingberg, U.S. Pat. No. 3,245,175, however, have each disclosed a flower support device that provides two, spaced-apart, transverse, reticulated or perforated members for receiving and holding plant stems within a floral arrangement. Although each of these devices was capable of providing the desired enhanced stability to a floral arrangement, and each permitted disposing the stems at any desired angle, no provision was made for accommodating plant stems of widely varying diameters within a single floral arrangement.

SUMMARY OF THE INVENTION

Accordingly, it is an object of the invention to provide a floral arranging device that will grasp plant stems of widely varying diameters at at least two, spaced-apart locations along the lengths of the stems, and that will maintain each of the stems at any desired angle. In a first embodiment, the device comprises a first, substantially annular ring disposed about an axis A—A. The ring has an upper, annular margin and a lower annular margin joined by cylindrical inner and outer walls. The first embodiment further comprises three sets of parallel, spaced-apart, elastic bands. In each of the three sets of elastic bands, each band is stretched around opposite sides of the outer wall and over the upper margin and under the lower margin of the first annular ring. What distinguishes each of three sets of bands from each other, however, is their orientation with respect to axis A—A: the second set is rotated through a first rotation angle with respect to the first set, and the second set is rotated through a second rotation angle with respect to the second set. The first and second rotation angle are each between 25 and 65 degrees. The first annular ring preferably has a plurality of circumferentially-spaced, axially-aligned, oppositely disposed pairs of slots on the outer wall thereof, said slots being circumferentially arranged to hold the first, second and third set of bands in their respective rotational alignment with respect to one another, and wherein each band is stretched around an oppositely-disposed pair of said slots. Optionally, rubber cement is applied to each slot to secure a portion of an elastic band therein. Because of the elasticity of the bands, plant stems of widely varying diameters can be incorporated into a single floral arrangement. Moreover, each of the stems is grasped at two locations—namely, between adjacent band portions stretched over the top of the ring and between adjacent band portions stretched under the bottom of the ring. Optionally, the outer wall of the ring is convexly curved from lower margin to upper margin; alternatively, it may be outwardly flared.

In a second embodiment, the device further includes a fourth set of parallel, spaced-apart, elastic bands. Each of the bands is stretched around opposite sides of the outer wall, and over the upper margin and under the lower margin of the first annular ring. The fourth set of bands is rotated about axis A—A through a third rotation angle with respect to the third set of bands. The third angle is preferably between 25 and 90 degrees.

In a third embodiment, an annular enclosure is added to the second embodiment. The enclosure surrounds and is coaxial with the first ring of the second embodiment. The enclosure has a circular upper lip and a circular lower lip joined by inner and outer walls. The outer wall of the enclosure has a diameter substantially equal to the diameter of the outer wall of the first ring. This third embodiment further includes a fifth set of parallel, spaced-apart elastic bands. Each of the bands is stretched around opposite sides of the outer wall, and over the upper lip and under the lower lip, of the enclosure. The fifth set of bands are rotated about axis A—A through a fourth rotation angle with respect to the fourth set of bands. The third embodiment further includes a sixth set of parallel, spaced-apart elastic bands. Each of the bands are stretched around opposite sides of the outer wall, and over the upper margin and under the lower margin, of the enclosure. The sixth set of bands is rotated about axis A—A through a fifth rotation angle with respect to the fifth set of bands. Preferably, the fourth and fifth rotation angles are between 25 and 90 degrees. Preferably, the upper and lower lips each have a plurality of oppositely-disposed pairs of slots, which slots are circumferentially-spaced to hold the fourth, fifth and sixth set of bands in their respective rotational relationships with respect to one another. Each band of the fourth, fifth and sixth sets is stretched around an oppositely-disposed pair of slots.

In a fourth embodiment, the device includes first, second, third and fourth annular rings axially-spaced and sequentially-aligned on a common axis A—A. Each annular ring has an upper, annular margin and a lower annular margin joined by cylindrical inner and outer walls. Spacer means are attached to the rings for maintaining the axial spacing between the rings. The spacer means may include a plurality of circumferentially spaced-apart, axially-extended posts interposed between and attached to adjacent rings. For each of the rings, there is a first, second, third and fourth set of parallel, spaced-apart elastic bands. Each of the four sets of bands for the second and third rings are looped around each of those rings, generally in the manner previously described for the second embodiment—that is, for each of the second and third rings, each of the bands is stretched around opposite sides of the outer wall, over the upper margin and under the lower margin of the ring. The first and fourth rings, however, share the same four sets of bands; those bands extend over the the upper margin of the fourth ring, down opposite sides of the device and under the lower margin of the first ring. Each set of bands associated with each ring is oriented at 25 to 90 degrees of rotation about axis A—A with respect to the adjacent set of bands. Preferably, each of the rings has a plurality of circumferentially-spaced, oppositely-disposed pairs of slots on the outer wall thereof. The slots are circumferentially arranged to hold the first, second, third and fourth sets of bands in their respective rotational relationships with respect to one another. Each band is stretched around an oppositely-disposed pair of slots.

These differing embodiments are intended to assist a floral designer in implementing floral design principles, such as harmony, rhythm, balance, line, form and mass, in a wide variety of settings, ranging from small, hand-held bouquets to very large floral designs for banquet halls and hotel lobbies. Moreover, each of these embodiments maintains the integrity of a floral design, both in transit and in movement from container to container.

DETAILED DESCRIPTION OF THE INVENTION

Figure 1:
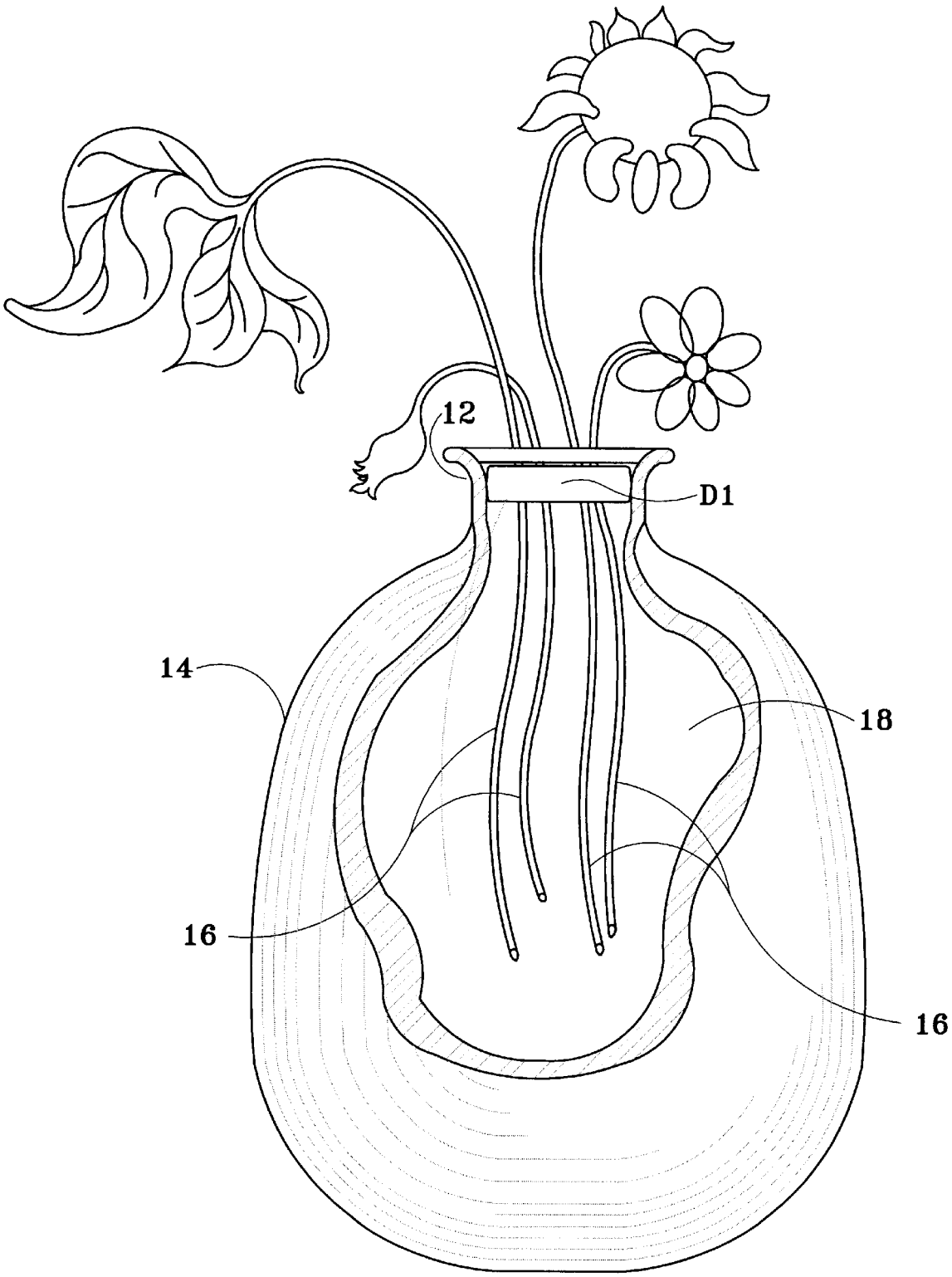
FIG. 1 is a side elevational view of a first embodiment of the device mounted in the mouth of a vase (partially cutaway), with plant stems inserted through interstices between the elastic bands of the device.
Figure 2:
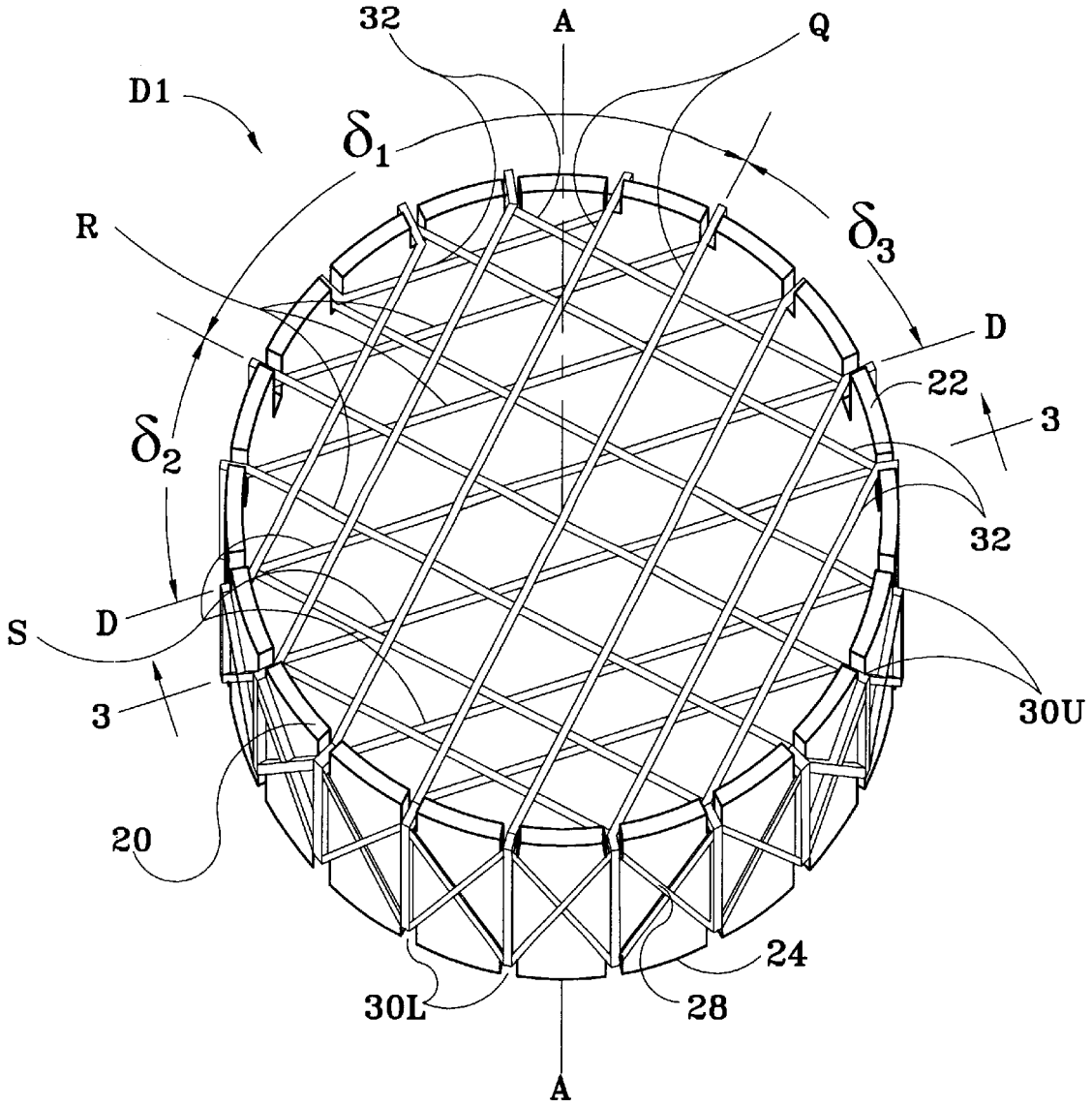
FIG. 2 is an enlarged, perspective view of the device of FIG. 1.
Figure 3:
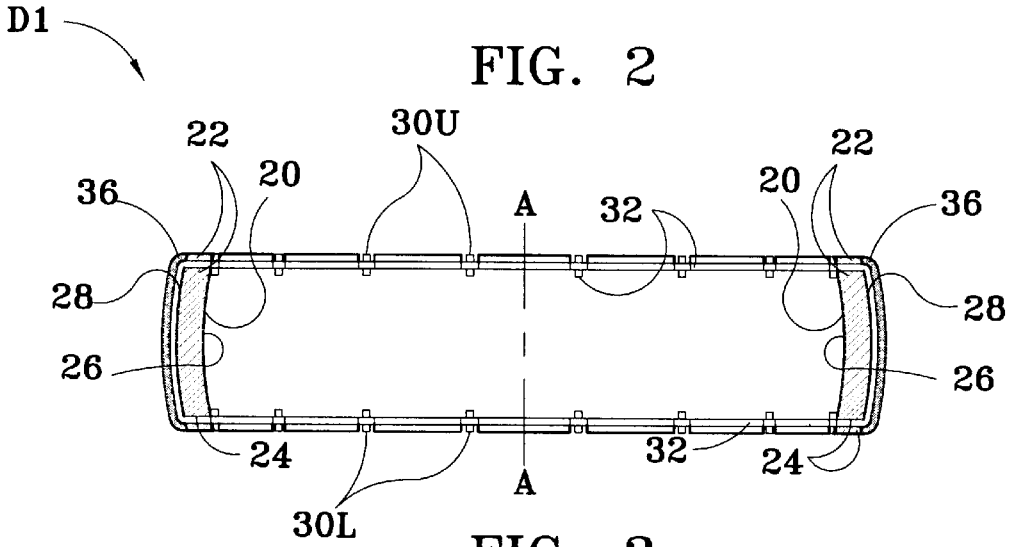
FIG. 3 is a transverse sectional view thereof taken along line 3—3 of FIG. 2.
Figure 4:
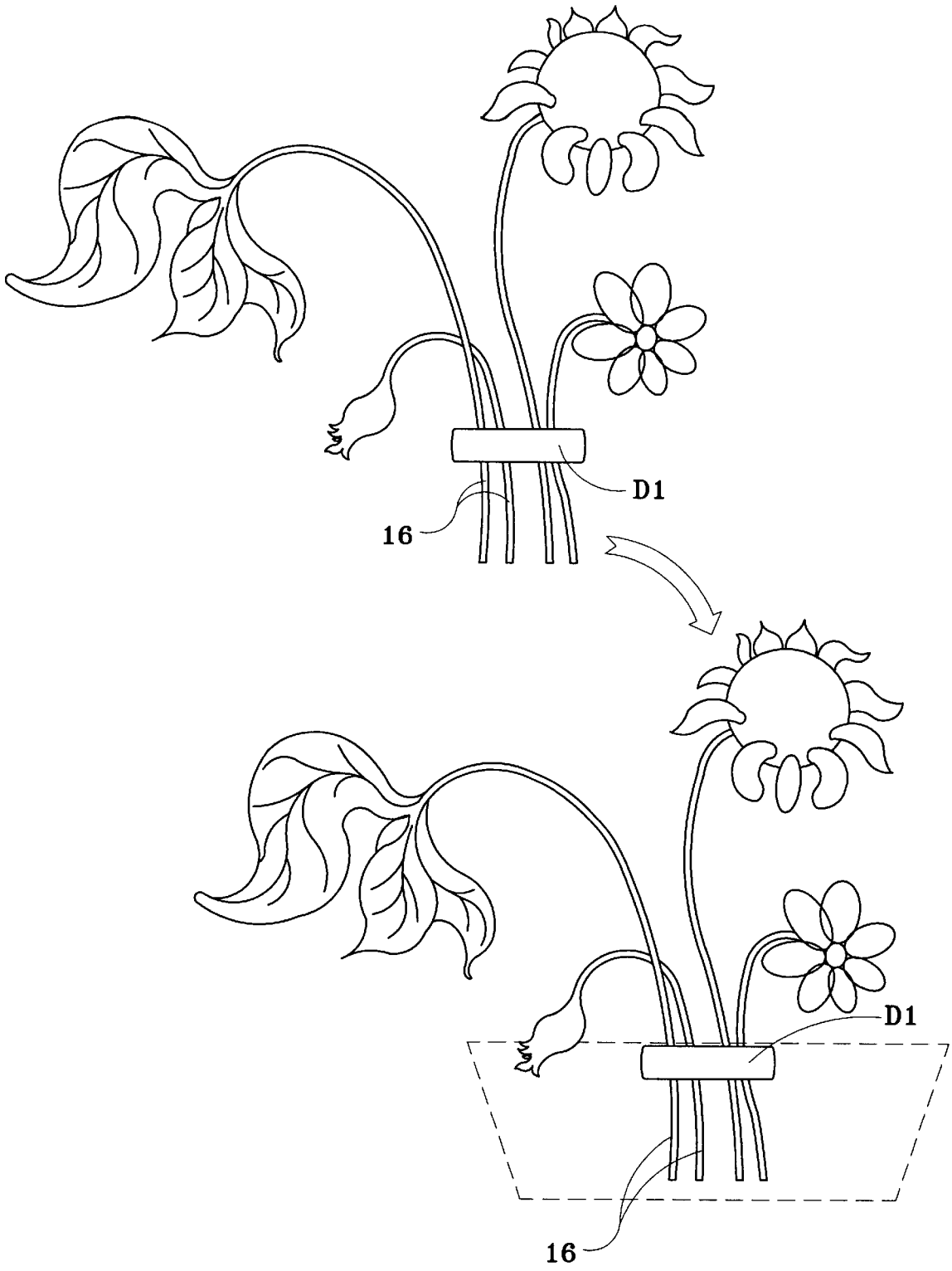
FIG. 4 depicts the device of FIG. 1 removed from the vase with the attached plant stems cut short, and the combination of the device and plant stems being placed into a shallow receptacle (shown in phantom outline).

Referring to FIG. 1, a first embodiment of the device, denoted generally by $D_1$, is shown mounted in the open mouth or neck 12 of a flower vase 14. Plant stems 16 are shown inserted through the device 12 from which they depend into the interior space 18 of the vase 14. Referring to FIGS. 2 and 3, it may be seen that the device has a first, substantially annular ring 20 disposed about an axis A—A. The ring 20 has an upper margin 22 and a lower margin 24 joined by a substantially cylindrical inner wall 26 and outer wall 28. The ring 20 has a plurality of radially-directed, upper slots 30U and a corresponding, equal number of radially-directed, lower slots 30L that are circumferentially spaced apart around the upper margin 22 and the lower margin 24, respectively. For each upper slot 30U, the corresponding lower slot 30L is preferably axially-aligned therewith, but need not be. The spacing between the slots 30U, 30L is chosen to correspond to the spacing desired between the elastic bands 32 within each of three sets of elastic bands (described below), which, in turn, will depend upon the plant stem diameters that are to be inserted through the device $D_1$: larger diameter plant stems 16 will require greater spacing between the slots 30U, 30L than will those of smaller diameter.

Figure 5:
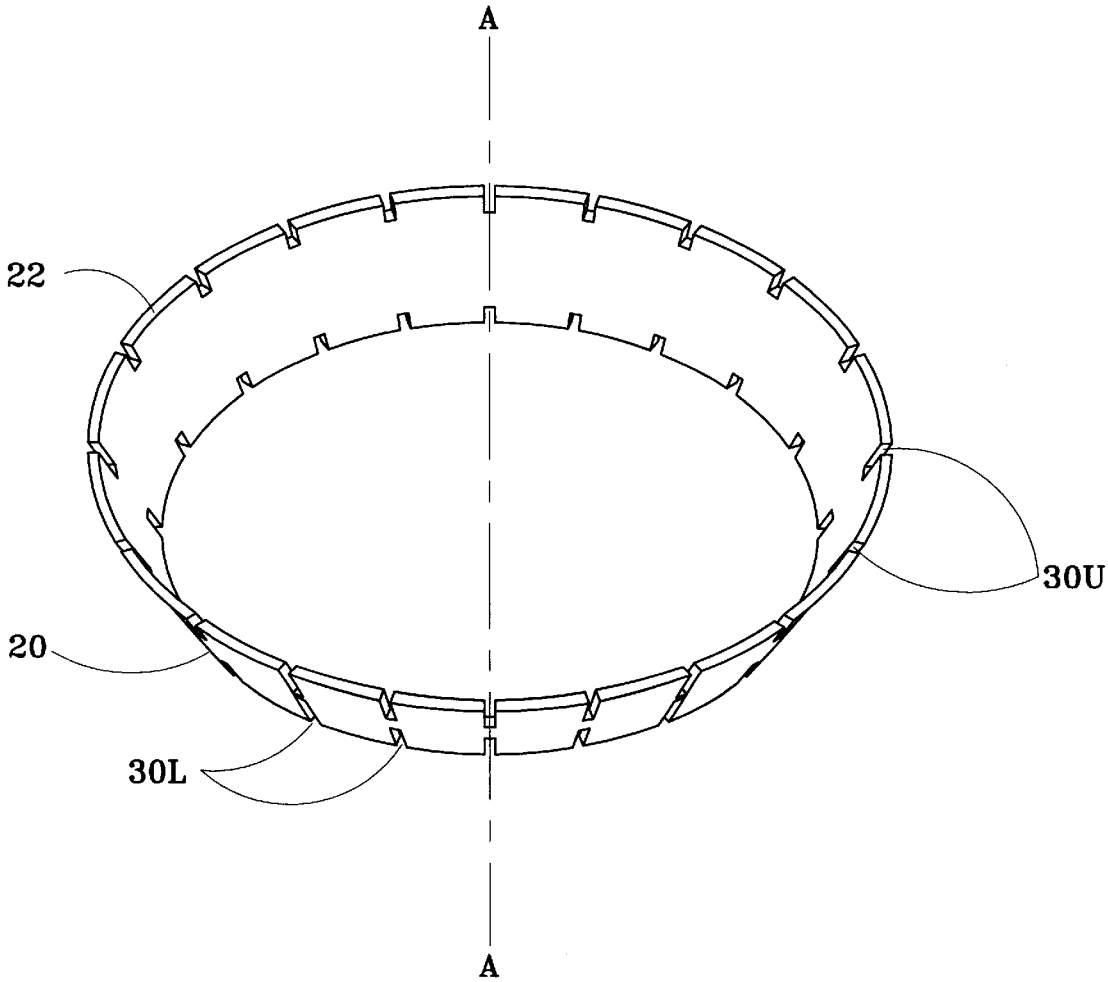
FIG. 5 is a flared, alternate version of the ring of the first embodiment.

The first embodiment further includes a first, second and third set of elastic bands, Q, R and S, respectively. Each of the sets Q, R, S comprises a plurality of parallel, spaced-apart elastic bands 32. Each band 32 in each of the sets Q, R, S is a single loop that extends through and between oppositely-disposed upper slots 30U in the upper margin 22 and through and between lower slots 30L in the lower margin 24, and stretches around opposite sides of the outer wall 28, as may best be seen, for example, in FIG. 3. The second set R has an angular orientation with respect to the first set; that is, the second set R is rotated counterclockwise (as viewed in FIG. 2) around axis A—A through a first angle 61 with respect to the first set Q, where $\delta_1$ is preferably between 25° and 90°. The third set S has an angular orientation with respect to the second set R; that is, the third set S is rotated counterclockwise around axis A—A through a second angle $\delta_2$ with respect to the second set R, where $\delta_2$ is preferably between 25° and 90°. Thus, each upper slot 30U and each lower slot 30L simultaneously receives and partially encloses portions of three separate bands 32—i.e., one from each of the sets Q, R, and S. Preferably, the portions of the bands 32 within each slot 30U, 30L as well as the entire outer wall 28 are coated with rubber cement 36. Since the elastic bands 32 pass both over and under the ring 20, any plant stems 16 that extend through the interstices between the bands 32 are engaged by the bands 32 at two spaced-apart locations along the lengths of the stems 16. Moreover, the rotational orientations of the three sets Q, R, and S provide multiple such interstices of varying sizes to accommodate a variety of angular attitudes for stems 16 while at the same time accommodating stems of varying diameters—all within a single floral arrangement. Although the outer wall 28 of the ring 20 of the first embodiment D. is shown convexly curved in FIGS. 2–3, alternatively the outer wall 28 may be outwardly flared from lower 22 margin to upper margin 24 as shown in FIG. 5.

In a third embodiment, denoted generally by $D_3$, a device $D_2$ according to the second embodiment (i.e., an annular ring

40 carrying elastic bands sets Q, R, S and T, stretched through and between upper slots 44U and lower slot 46L, all as previously described), is surrounded by, and mounted within, an annular, axially-extended enclosure 42 that is coaxial with the ring 40 and axis A-A. The enclosure 42 has an upper circular lip 48 and a lower circular lip 50 joined by a substantially cylindrical inner wall 52 and a substantially cylindrical outer wall 54. The upper and lower lips 48, 50 have a plurality of radially-directed, circumferentially-spaced slots 48U, 50L, respectively, similar to those of the third embodiment. Each of a plurality of elastic bands 32 in a fifth set U of parallel, spaced-apart elastic bands extend around opposite sides of the outer wall 54 of the enclosure 42, over the upper lip 48 and under the lower lip of the enclosure 42, being thereby stretched between oppositely-disposed pairs of upper and lower slots 48U, 50L. Likewise, a sixth, seventh, and eighth set of parallel, spaced-apart elastic bands V, W, X underlay the fifth set, except that each of the succeeding sets V, W, X is oriented at an angle with respect to the overlying adjacent set: set V is rotated around axis A-A through a fourth angle $\S_4$ with respect to set U; set W is rotated around axis A-A through a fifth angle $\S_4$ with respect to set V; and set X is rotated around axis A-A through a sixth angle $\S_6$ with respect to set W. Each of the angles $\S_4$, $\S_5$, $\S_6$ is between 25° and 90°.

Figure 11:
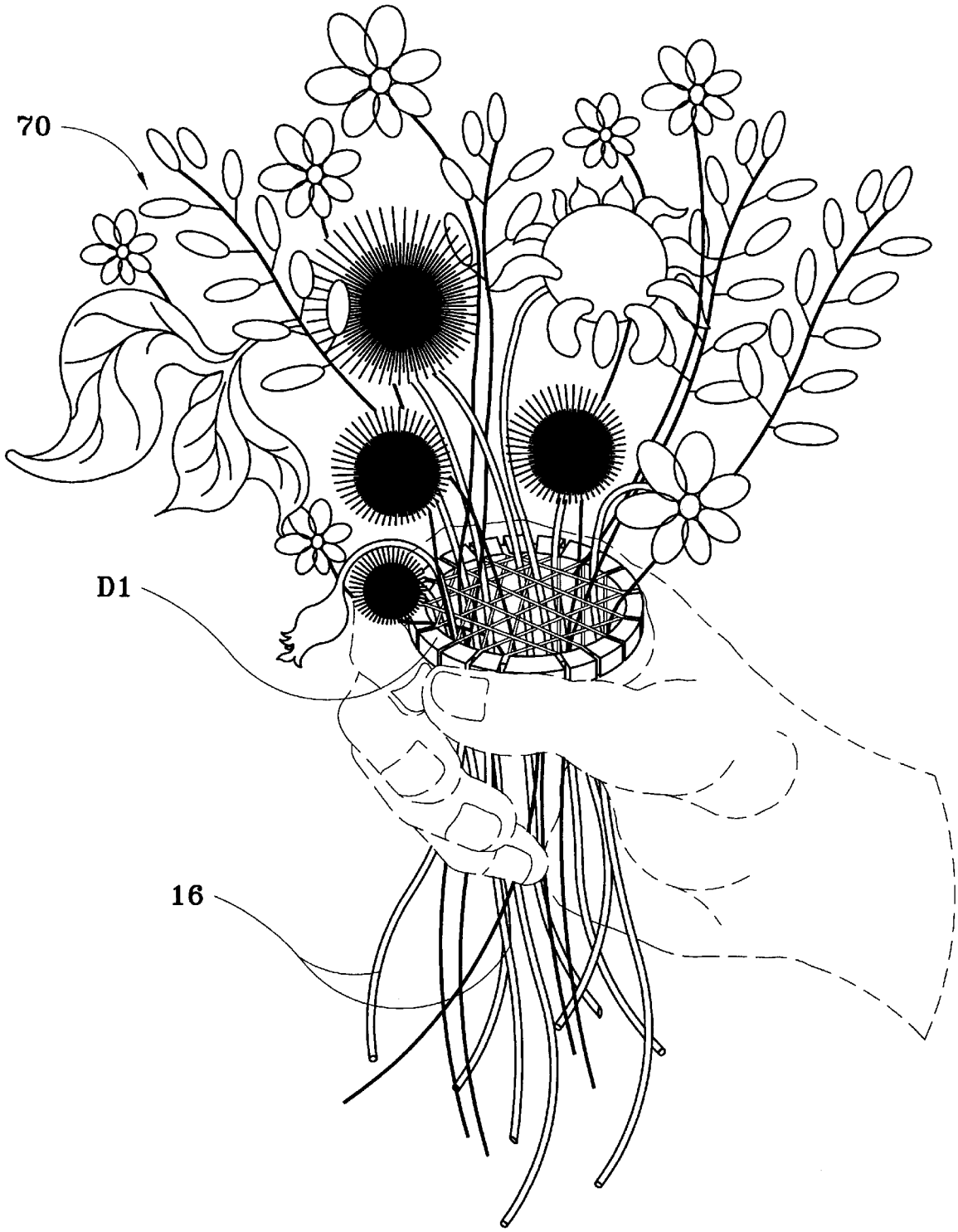
FIG. 11 is a perspective view of the first embodiment adapted for use in a bridal bouquet and shown held by a human hand (in phantom outline).

Various modifications and changes will become obvious to those of ordinary skill in the art. Since the device should be unobtrusive, the ring 20 in each of the embodiments $D_1$, D2 is preferably made of a clear plastic—clear acrylic or plexiglass, for example. The elastic bands 32 may be made of rubber or any suitably elastic and durable substance. The elastic bands 32 may be individual loops of elastic material that are just large enough to stretch once around a ring, but they need not be. Instead, the bands 32 can be formed by a single, continuous strand of elastic material that is threaded through the oppositely-disposed pairs of upper and lower slots 30U, 30L, 48U, 48L and wound repeatedly around the rings 20, 40 to create the various elastic band patterns of devices $D_1$-D3 depicted in FIGS. 2–11. For instance, to create all three sets of bands for device $D_1$, one could use three separate strands of elastic material—that is, a different strand to form each of the sets of bands J, K, and L; or, alternatively, all three sets of bands J, K, and L, could be formed from a single, long strand of elastic material wound repeatedly around ring 20. The number and arrangement of the elastic bands 32 can also vary depending on the size of the vase or receptacle, the intended use of the floral design, and the number and size of the floral pieces to be arranged. For instance, as shown in FIG. 11, the first embodiment of the device $D_1$ is adapted for use in a hand-held bridal bouquet 70 by limiting the diameter of the ring to 1.25 inches, more or less, and by limiting the number of elastic bands 32 in each of the three sets of bands to only three. It is the intent that these changes and modifications are to be encompassed within the spirit of the appended claims and that the invention described herein and shown in the accompanying drawings are illustrative only and are not intended to limit the scope of the invention.

I claim:

1. A floral arranging device for receiving and supporting plant stems in spaced relation, comprising:

a first, substantially annular ring disposed about an axis (A—A), said ring having an upper, annular margin and a lower annular margin joined by cylindrical inner and outer walls;

a first set of parallel, spaced-apart elastic bands, said bands being stretched between opposite sides of the upper margin and between opposite sides of the lower margin of said first annular ring;

a second set of parallel, spaced-apart elastic bands, said bands being stretched between opposite sides of the upper margin and between opposite sides of the lower margin of said first annular ring, each of the bands of said second set being rotated about axis (A—A) through a first rotation angle with respect to the first set of bands;

a third set of parallel, spaced-apart elastic bands, said bands being stretched between opposite sides of the upper margin and between opposite sides of the lower margin of said first annular ring, each of the bands of said third set being rotated about axis (A—A) through a second rotation angle with respect to the second set of bands;

wherein the first rotation angle is between 25 and 90 degrees and the second rotation angle is between 25 and 90 degrees.

2. The device of claim 1, wherein the first annular ring has a plurality of circumferentially-spaced, oppositely disposed pairs of slots on the outer wall thereof, said slots being circumferentially arranged to hold the first, second and third sets of bands in their respective rotational alignments with respect to one another, and wherein each band is stretched between an oppositely-disposed pair of said slots.

3. The device of claim 2, further comprising rubber cement applied to each slot to secure a portion of an elastic band therein.

4. The device of claim 3, wherein the bands in each set are uniformly spaced apart.

5. The device of claim 4, wherein the outer wall is convexly curved from lower margin to upper margin.

6. The device of claim 1, wherein the outer wall is outwardly flared from lower margin to upper margin, and wherein the first annular ring has a plurality of oppositely-disposed pairs of slots on the upper and lower margins thereof, said slots being circumferentially spaced to hold the first, second and third sets of bands in their respective rotational alignments with respect to one another, and wherein each band is stretched around an oppositely-disposed pair of said slots.

7. The device of claim 1, 2, 3, 4, 5, or 6, further comprising a fourth set of parallel, spaced-apart elastic bands, said bands being stretched between opposite sides of the upper margin and between opposite sides of the lower margin of said first annular ring, each of the bands of said fourth set being rotated about axis (A—A) through a third rotation angle with respect to the third set of bands.

8. The device of claim 7, wherein the third rotation angle is between 25 and 90 degrees.

9. The device of claim 4, further comprising:

an annular enclosure surrounding and coaxial with said first ring, said enclosure having a circular upper lip and a circular lower lip joined by inner and outer walls, said outer wall having a diameter substantially equal to the diameter of the outer wall of said first ring;

a fourth set of parallel, spaced-apart elastic bands, each of said bands being stretched around opposite sides of the outer wall of the enclosure and over the upper lip and under the lower lip of said first enclosure;

a fifth set of parallel, spaced-apart elastic bands, each of said bands being stretched around opposite sides of the outer wall, and over the upper lip and under the lower lip, of the enclosure, each of the bands of said fifth set being rotated about axis (A—A) through a fourth rotation angle with respect to the fourth set of bands;

a sixth set of parallel, spaced-apart elastic bands, each of said bands being stretched around opposite sides of the outer wall, and over the upper margin and under the lower margin, of the enclosure, each of the bands of said sixth set being rotated about axis (A—A) through a fifth rotation angle with respect to the fifth set of bands.

10. The device of claim 9, wherein the fourth rotation angle is between 25 and 90 degrees and the fifth rotation angle is between 25 and 90 degrees.

11. The device of claim 10, wherein the upper and lower lips each have a plurality of oppositely-disposed pairs of slots, said slots being circumferentially spaced to hold the fourth, fifth and sixth sets of bands in their respective rotational relations with respect to one another, and wherein each band is stretched around an oppositely-disposed pair of slots.

* * * * *

UNITED STATES PATENT AND TRADEMARK OFFICE

CERTIFICATE OF CORRECTION

Figure 6:
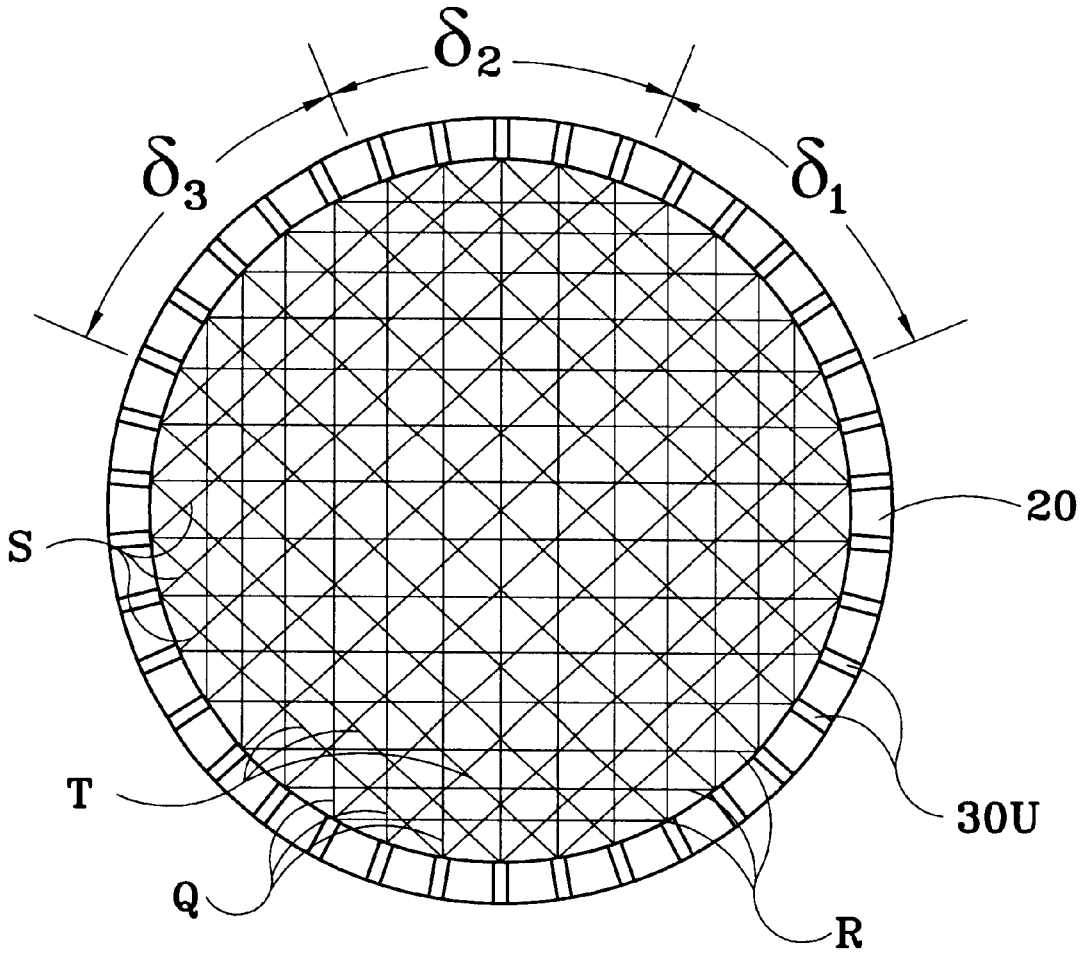
FIG. 6 is an enlarged, top plan view of a second embodiment of the device.
Figure 7:
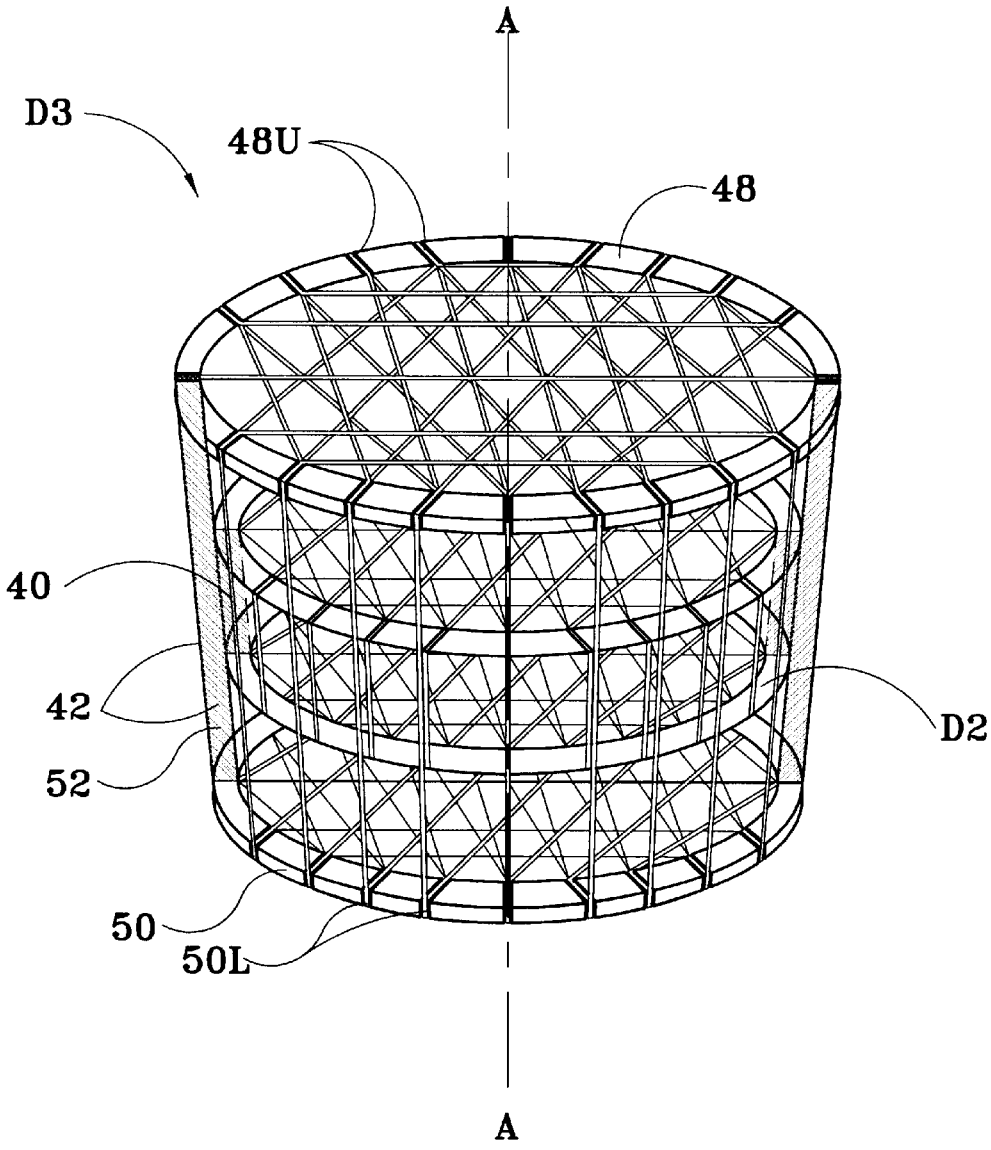
FIG. 7 is a perspective view of a third embodiment of the device.
Figure 8:
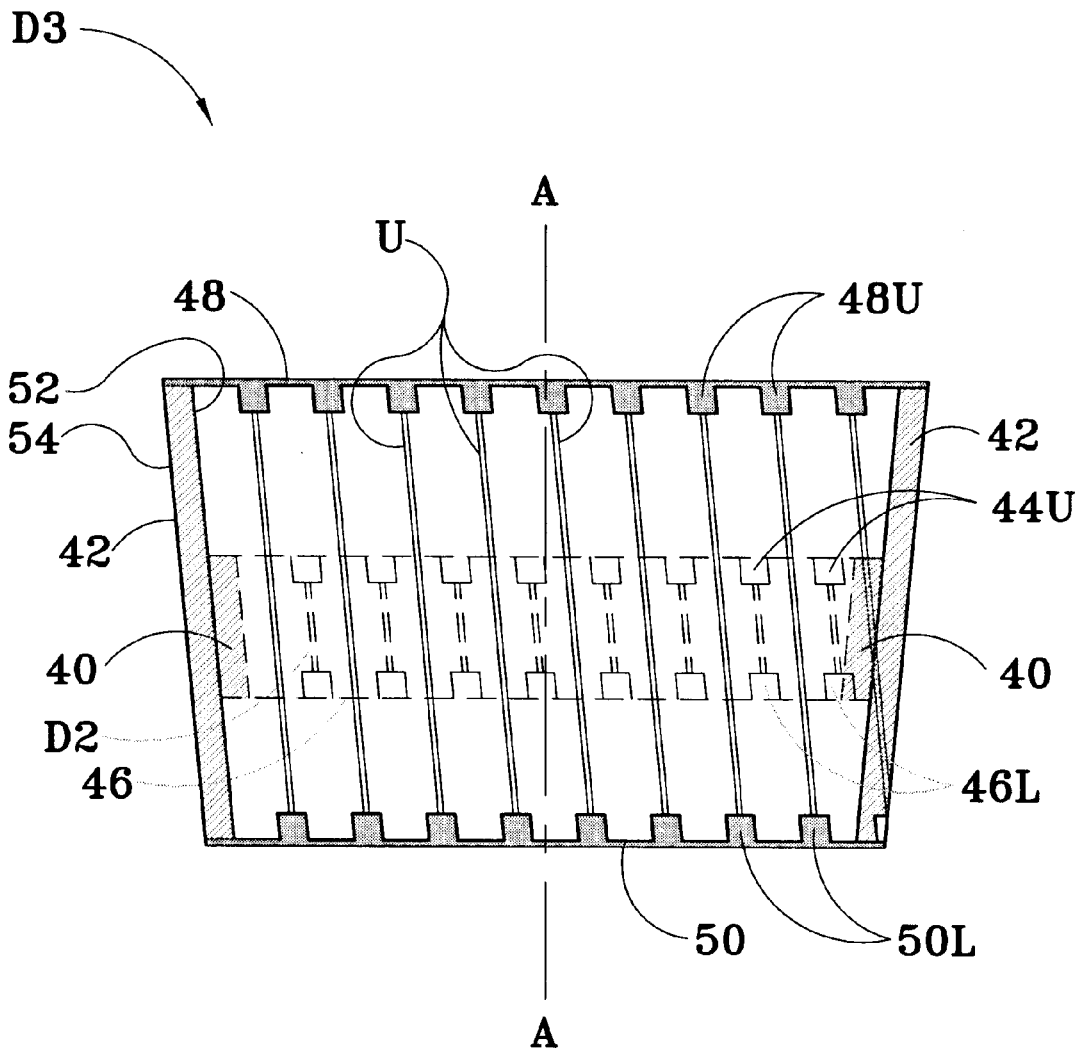
FIG. 8 is a side elevational view thereof.
Figure 9:
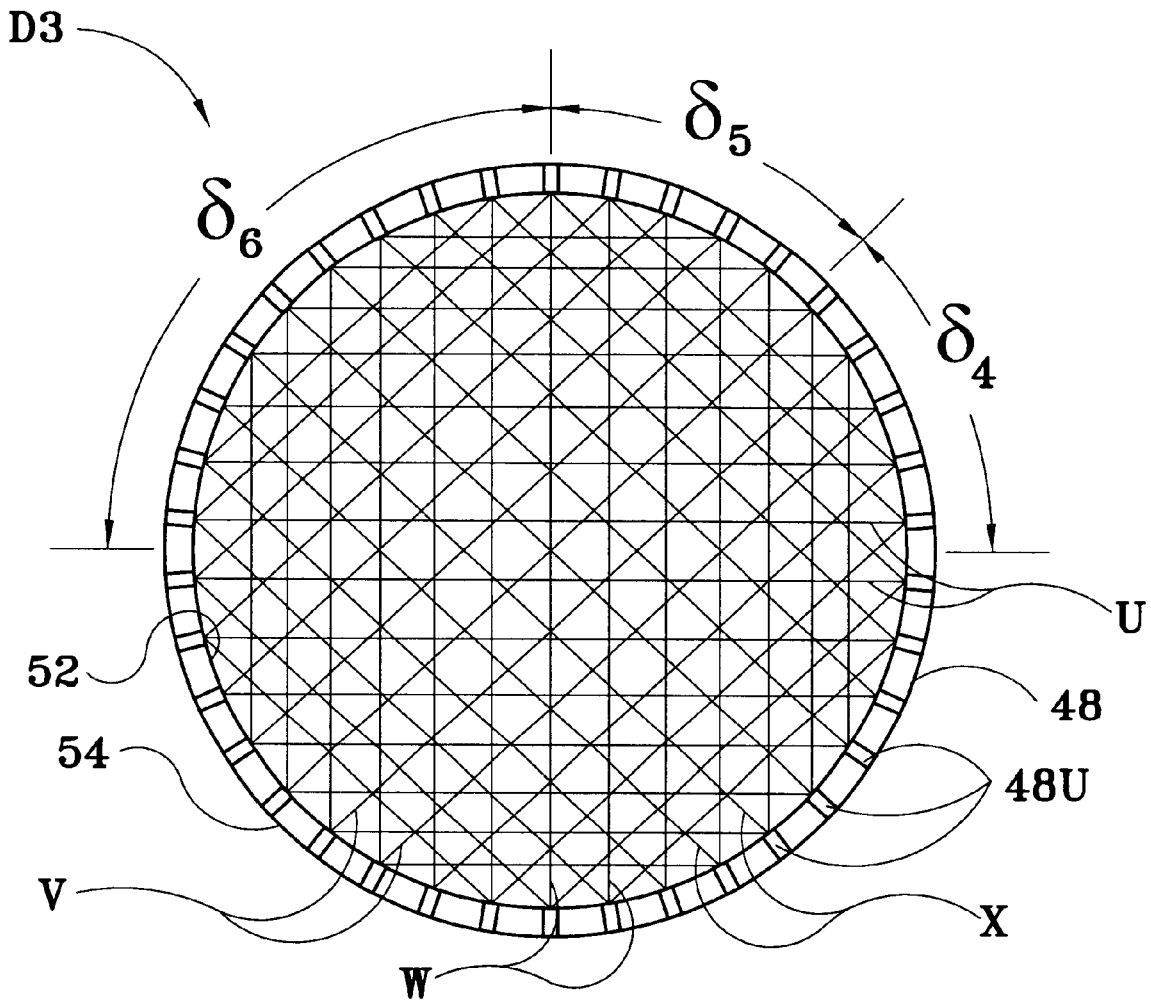
FIG. 9 is a top plan view thereof.
Figure 10:
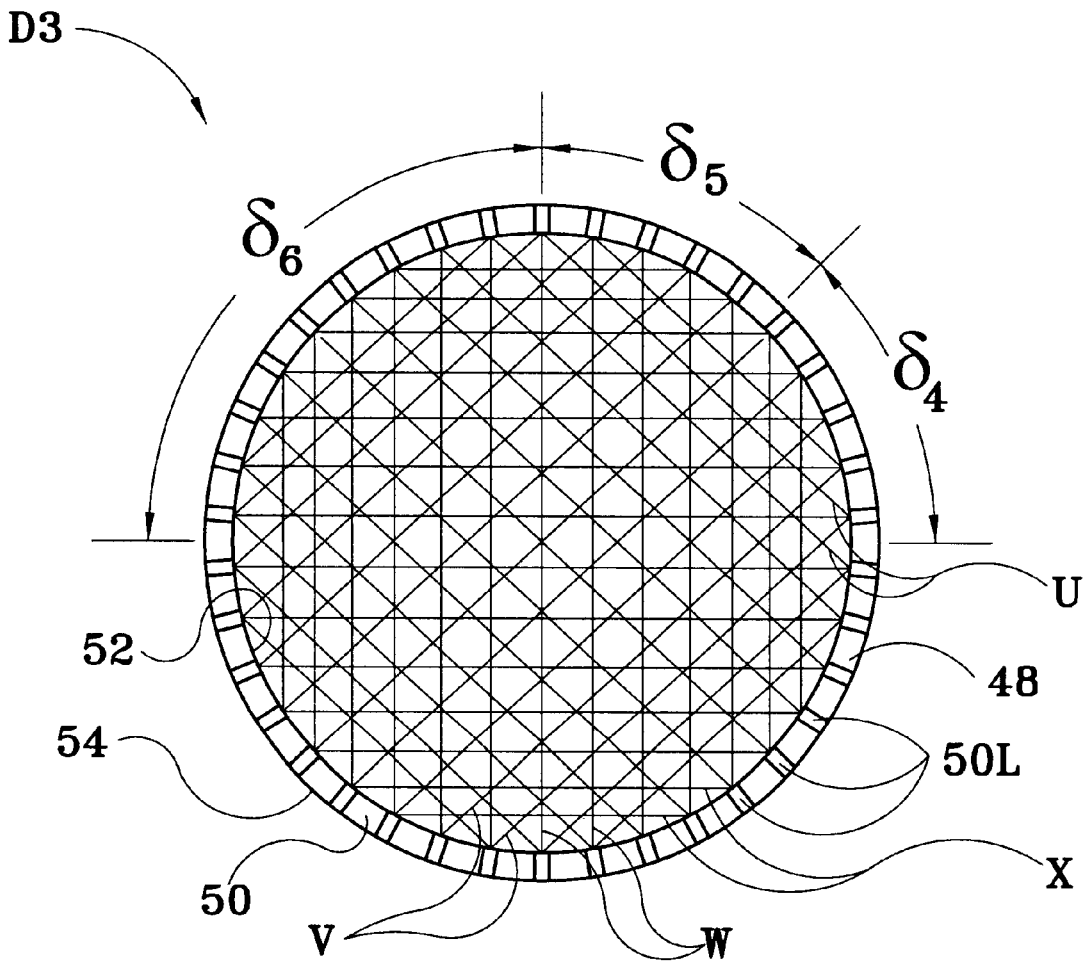
FIG. 10 is a bottom plan view thereof.

PATENT NO. : 6,523,301 B2
DATED : February 25, 2003
INVENTOR(S) : Vicke T. Delaney It is certified that error appears in the above-identified patent and that said Letters Patent is hereby corrected as shown below:

Column 4,
Line 66, insert the following:

-- In a second embodiment, denoted generally by $D_2$, there is added to the first embodiment a fourth set of parallel, spaced-apart elastic bands T, as depicted schematically in FIG. 6. The bands 32 within the set T are each stretched around opposite sides of the outer wall 28, over the upper margin 22 and under the lower margin 24 of the ring 20 in the same manner as those of sets Q, R and S. The fourth set T has an angular orientation with respect to the third set S; that is, the fourth set S is rotated counterclockwise around axis A-A through a third angle $\S_3$ with respect to the third set S, where $\S_3$ is preferably between $25^o$ and $90^o$. --

Signed and Sealed this

Twenty-fourth Day of June, 2003

JAMES E. ROGAN
*Director of the United States Patent and Trademark Office*